US006281776B1

(12) United States Patent
Davidson

(10) Patent No.: US 6,281,776 B1
(45) **Date of Patent: *Aug. 28, 2001**

(54) THERMALLY ISOLATING TRANSFORMER

(75) Inventor: Howard L. Davidson, San Carlos, CA (US)

(73) Assignee: Sun Microsystems, Inc., Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/305,826

(22) Filed: May 5, 1999

(51) Int. Cl.[7] ..... H01F 27/08; H01F 17/06

(52) U.S. Cl. ..... 336/61; 336/178; 336/90; 336/96; 361/702

(58) Field of Search ..... 336/178, 96, 206, 336/90, 83, 61; 165/80.3, 185; 361/702, 704

(56) References Cited

U.S. PATENT DOCUMENTS 3,551,863 * 12/1970 Marton ..... 336/58
3,576,508 * 4/1971 Liberman ..... 336/165
3,684,925 * 8/1972 Naff, Jr. ..... 361/688
4,397,234 * 8/1983 Lee et al. ..... 101/93.29
4,543,555 * 9/1985 McDermott ..... 336/206
4,689,592 * 8/1987 Walker ..... 336/83
4,772,999 * 9/1988 Fiorina et al. ..... 363/141
4,956,626 * 9/1990 Hoppe et al. ..... 336/60
5,306,866 * 4/1994 Gruber et al. ..... 174/15.1
5,359,313 * 10/1994 Watanabe et al. ..... 336/178
5,731,666 * 3/1998 Folker et al. ..... 315/276
5,844,461 * 12/1998 Faulk et al. ..... 336/206

FOREIGN PATENT DOCUMENTS 55-105309 * 8/1980 (JP) ..... 336/178

* cited by examiner

*Primary Examiner*—Anh Mai
(74) *Attorney, Agent, or Firm*—Conley, Rose & Tayon, PC; B. NoëKivlin

(57) ABSTRACT

Heat emitting electrical components are encased in a refrigerated package within a housing which may be under vacuum. Power for the components is supplied through a transformer within the vacuum housing, the secondary of which is in thermal contact with the package and has heat transmitting electrical connections to the components. To reduce conduction or convection of heat from the primary of the transformer to the refrigerated package, a small gap of about 1 mil is provided. For pot core transformers the core may be split, with the gap between the split portions. For toroidal transformers, the secondary is spaced from the primary as well as from the core by such gap.

12 Claims, 8 Drawing Sheets

THERMALLY ISOLATING TRANSFORMER

BACKGROUND OF THE INVENTION

1. Field of the Invention

This invention relates to a new and improved thermally isolating transformer and to a system for maintaining electronic components at low temperatures which includes such a transformer. More particularly the invention relates to a transformer for the supply of power to refrigerated electronic components wherein a gap in the transformer core or a space between one of the coils and the core is created to reduce heat transfer from the transformer to the electronic components.

2. Description of Related Art

The concept of cooling electronic components is well recognized in the art. The supply of power to such components has resulted in conduction or convection of heat from transformer coils to the components. The present invention differs from prior efforts to reduce such heat transfer by creating a gap which isolates one winding of the transformer (which is, in turn, connected to the electronic components) from the transformer core or the creation of a gap in the transformer core.

SUMMARY OF THE INVENTION

One system for improving electronic component performance by reducing the temperature of such components comprises enclosing the components in a heat insulated package and refrigerating the package. Such package is enclosed in a housing which, in accordance with the present invention, is preferably under vacuum. Performance of a microprocessor can be enhanced significantly by effectively removing heat generated by certain electrical components. In addition, the operating speed of the microprocessor can be greatly increased if the microprocessor is operated at low temperatures. A transformer located in the housing has secondary windings which are connected to the components within the cold package to supply power thereto.

The present invention substantially reduces the amount of heat transferred from the transformer to the interior of the cold package. In one form of the invention, the interior diameter of one coil or winding (preferably the secondary) of the transformer is larger than the portion of the core around which the secondary is wound. A spacer may be positioned around the core and within the coil or there may simply be a gap at such location.

Another means for heat insulating the secondary from the primary of the transformer is to create a gap in the core. In either this form of the invention or that of the preceding paragraph, the gap or space reduces heat transfer from the primary coil or the core.

BRIEF DESCRIPTION OF THE DRAWINGS

The accompanying drawings, which are incorporated in and form a part of this specification, illustrate embodiments of the invention and, together with the description serve to explain the principles of the invention.

DETAILED DESCRIPTION OF THE PREFERRED EMBODIMENTS

Figure 1:
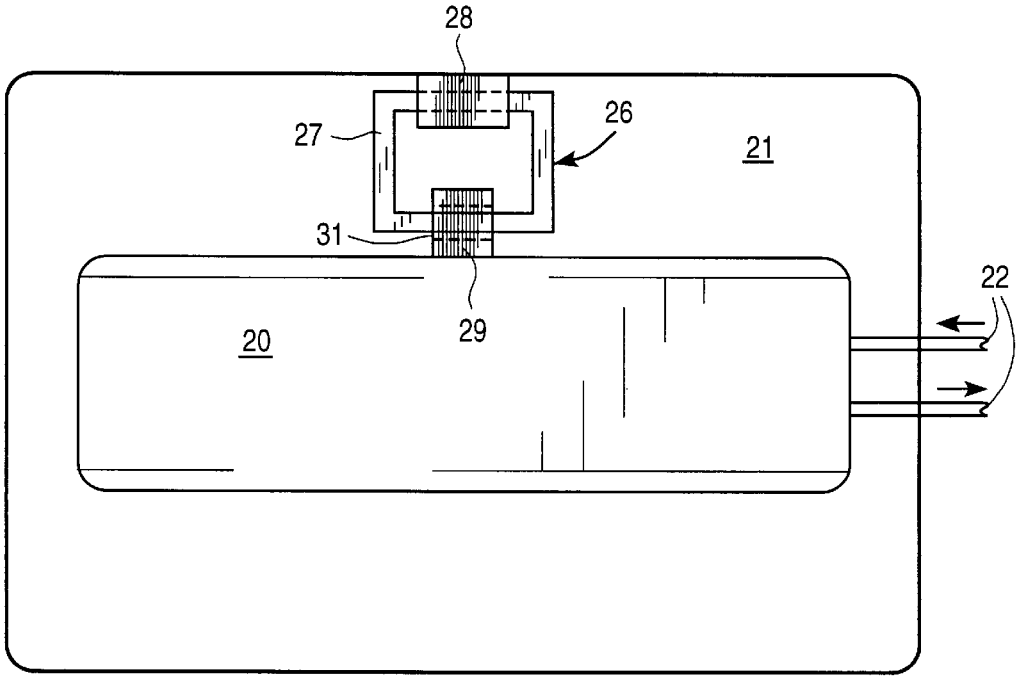
FIG. 1 is a schematic view of one system for transmitting power to the interior components of a cold electrical package which employs a gap between the interior of the secondary coil of the transformer and the core.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

It is desirable that electronic components be operated at reduced temperatures for speed and efficiency of operation. As shown schematically in FIG. 1, a cold electrical package 20 encloses such components (not shown) which may be mounted on a circuit board (not shown). Package 20 is heat insulated and refrigerant is circulated therethrough via conduits 22. It will be understood that other systems for cooling the package may be used. The package 20 and other components may be sealed within a housing 21 which is preferably under vacuum. Refrigeration of package 20 and maintaining housing 21 under vacuum are preferred, but the present invention may be used in more simple installations where excessive heat of electronic components is to be avoided. One component within the housing 21 is transformer 26 comprising a core 27, a primary coil 28 and a secondary coil 29. The windings of the coil 29 are connected to the components. It will be understood that the number of turns in coils 28 and 29 is subject to considerable variation. Customarily, secondary 29 has fewer turns than primary 28, but this feature is subject to variation and the number of turns in each coil may be the same. In general, primary coil 28 is hotter than coil 29. Power may be between a half watt and a few hundred watts and the voltage may be 5 volts or less in commercial computer installations.

Core 27, as well as all cores shown in other modifications may be made up of plural laminate of iron or ferrite, as well understood in the art. Such core has moderate thermal conductivity and hence there may be a heat gain to the package 20 if there were direct contact between the coil 29 and the core 27, assuming that the core 27 were continuous rather than being formed with a gap.

Accordingly, in accordance with the structure shown in FIG. 1, the heat generated by coil 28 is transmitted to the core 27 by conduction but, because of the space or gap 31 between the secondary coil 29 and the core 27 there is a reduction in heat transfer to the package 20.

Figure 2:
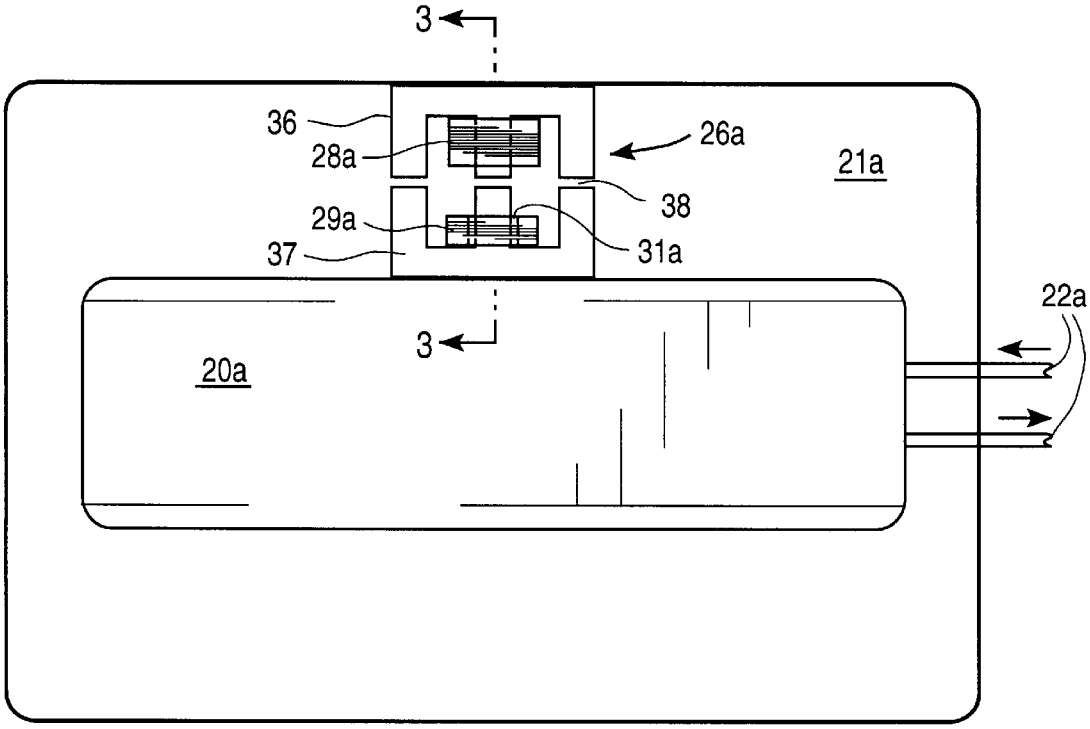
FIG. 2 is a view similar to FIG. I showing gaps in the transformer core to insulate the cold electrical package from the primary coil of the transformer.
Figure 3:
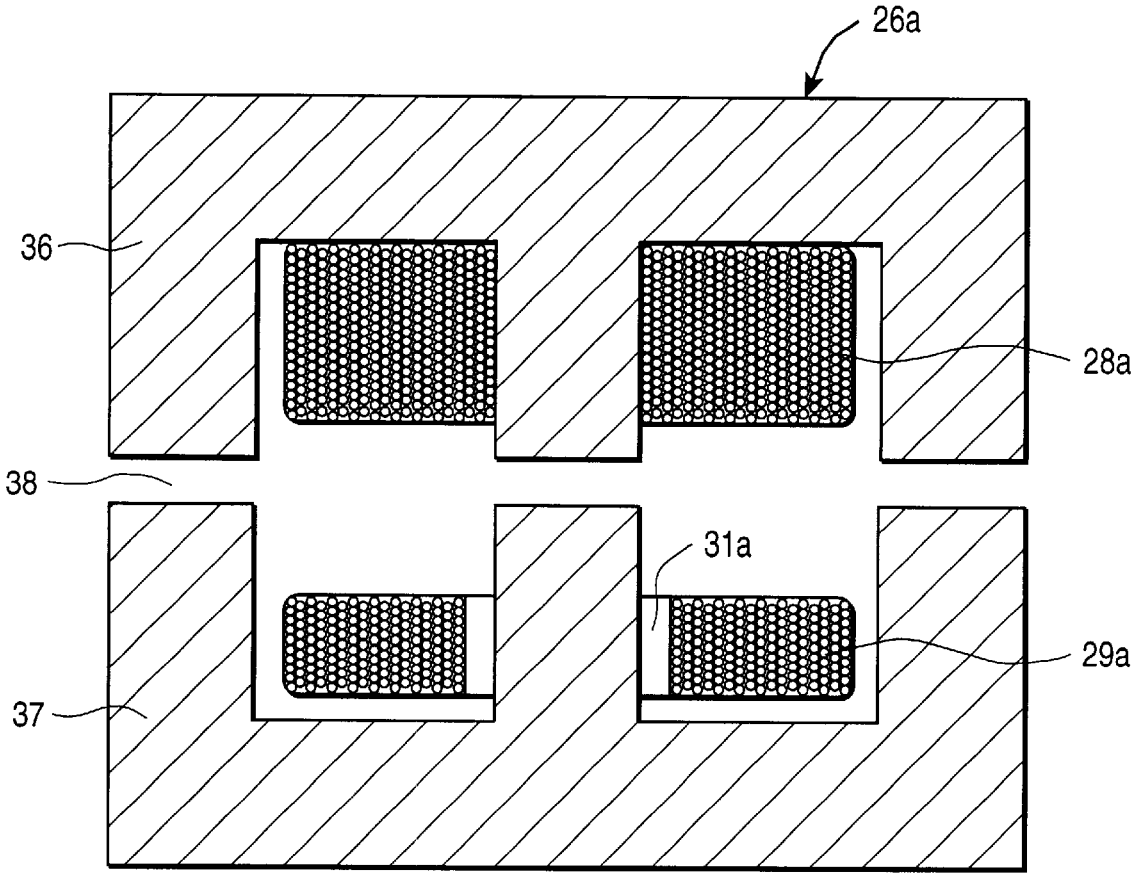
FIG. 3 is an enlarged, vertical sectional view through the transformer of FIG. 2 turned 90°.

Directing attention now to the structure of FIGS. 2 and 3, it will be seen that the transformer 26*a* is of a modified construction commonly referred to as an "E-core" shape. In this modification, there is a gap or space 38 running through the three arms of the core 36 which provides heat insulation between the primary coil 28*a* and the package 20*a*. It will also be seen that there is also a gap 31*a* between the secondary coil 29*a* and the core 36, although in many installations such a space 31*a* may be unnecessary.

Figure 4:
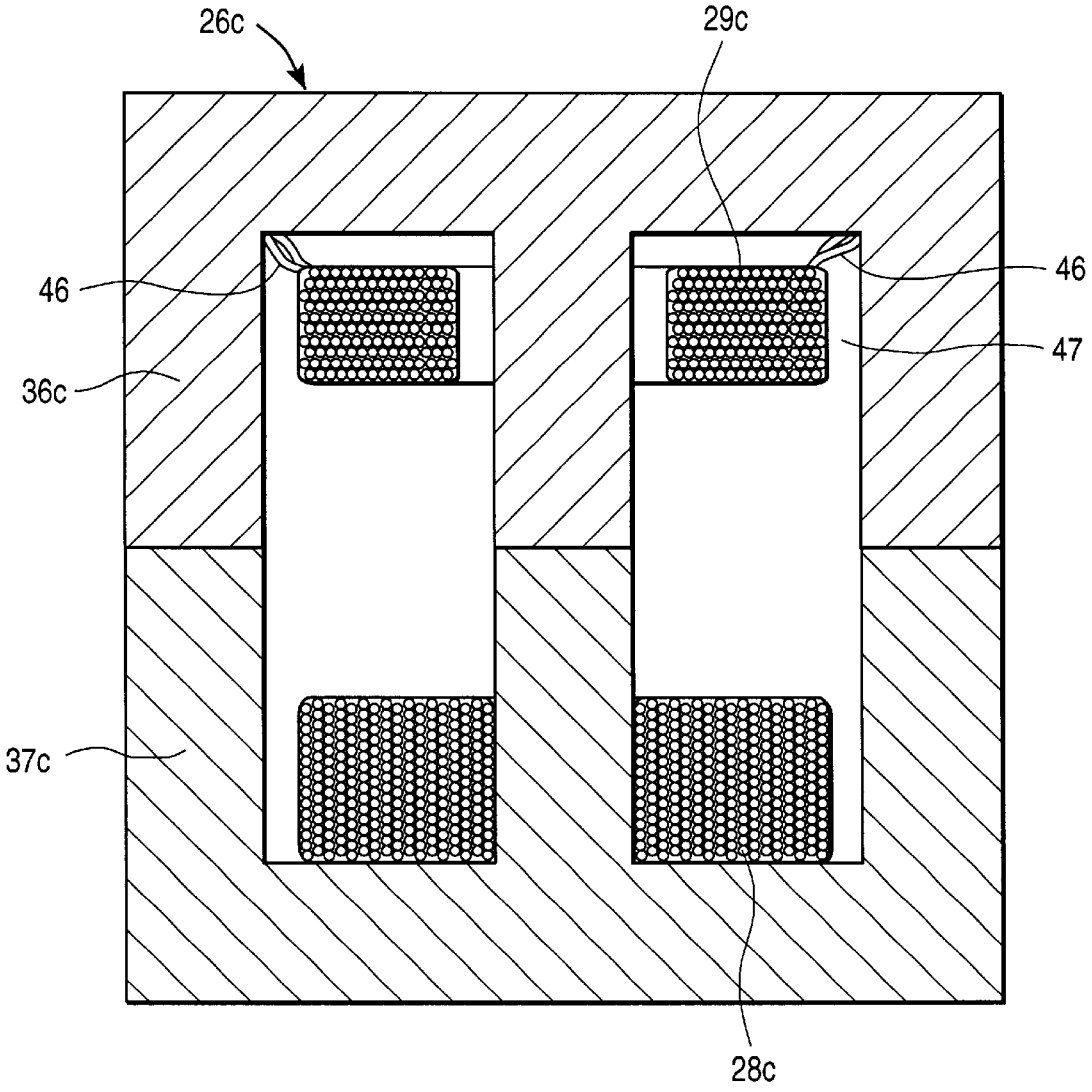
FIG. 4 is a view similar to FIG. 3 of a modified transformer.

In FIG. 4 it is shown that the secondary coils 29*c* are of lesser width than the primary coils 28*c* and thus there is a gap 47 around the secondary coils 29*c*. It is desirable that there be a heat sink attached to the secondary coil to further dissipate heat One such heat sink may comprise heavy copper wire 46 leading to coil 29*c* as shown in FIG. 4.

Figure 5:
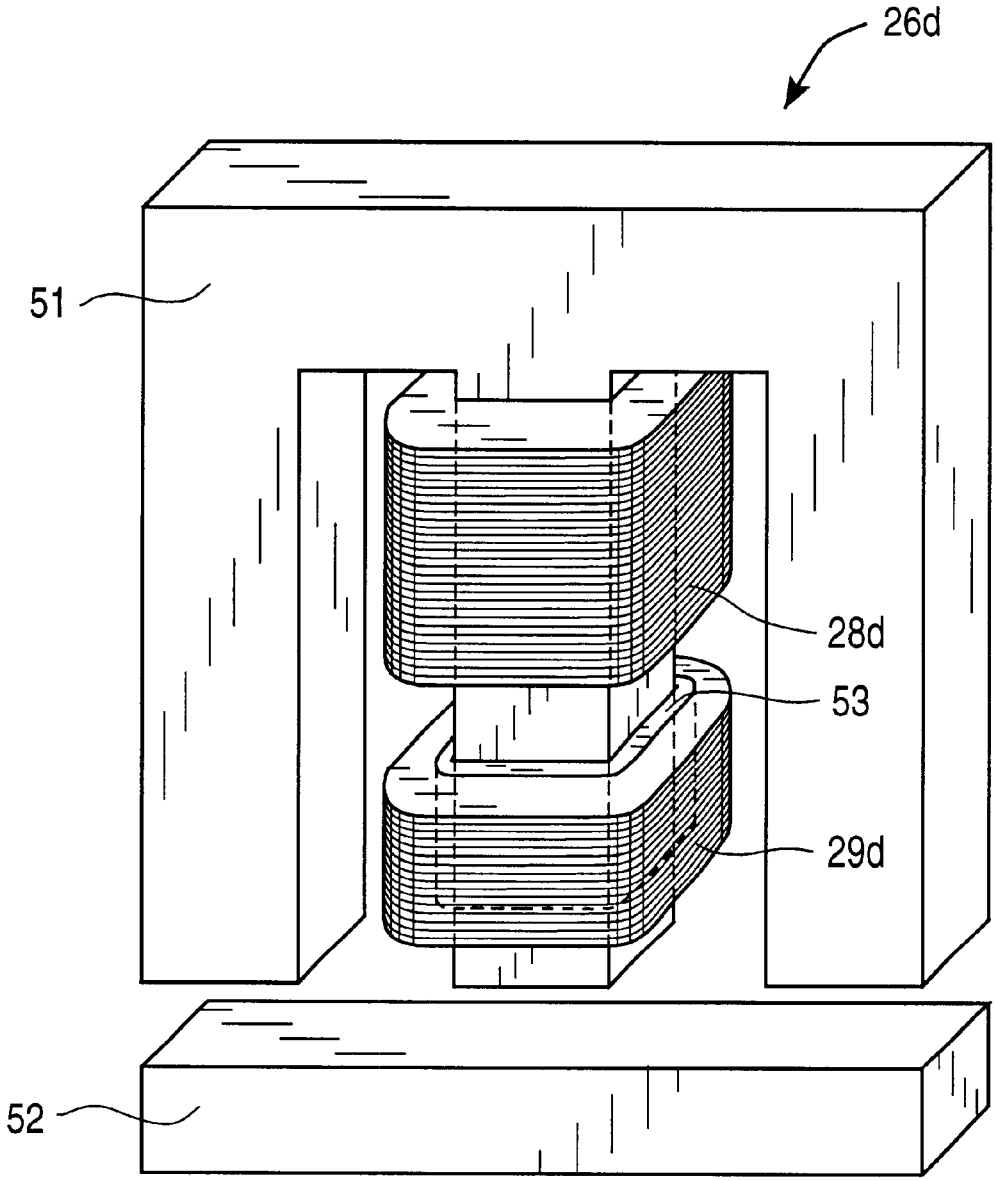
FIG. 5 is a view similar to FIG. 3 of a further modified transformer structure.

FIG. 5 illustrates a transformer 26*d* which varies from the shape shown in FIG. 3. Core 51 is an E-shaped member 51, the ends of the arms of the E being connected by transverse bar 52. In this form of the invention, the secondary coils 29*d* are wound larger than the central arm of portion 51 so that there is a space between the inside of the coils 29*d* and the core which provides heat insulation. A spacer 53 may be used to fill up the gap between the coils 29*d* and the core. Spacer 53 is of a material having low heat conductivity.

Figure 6:
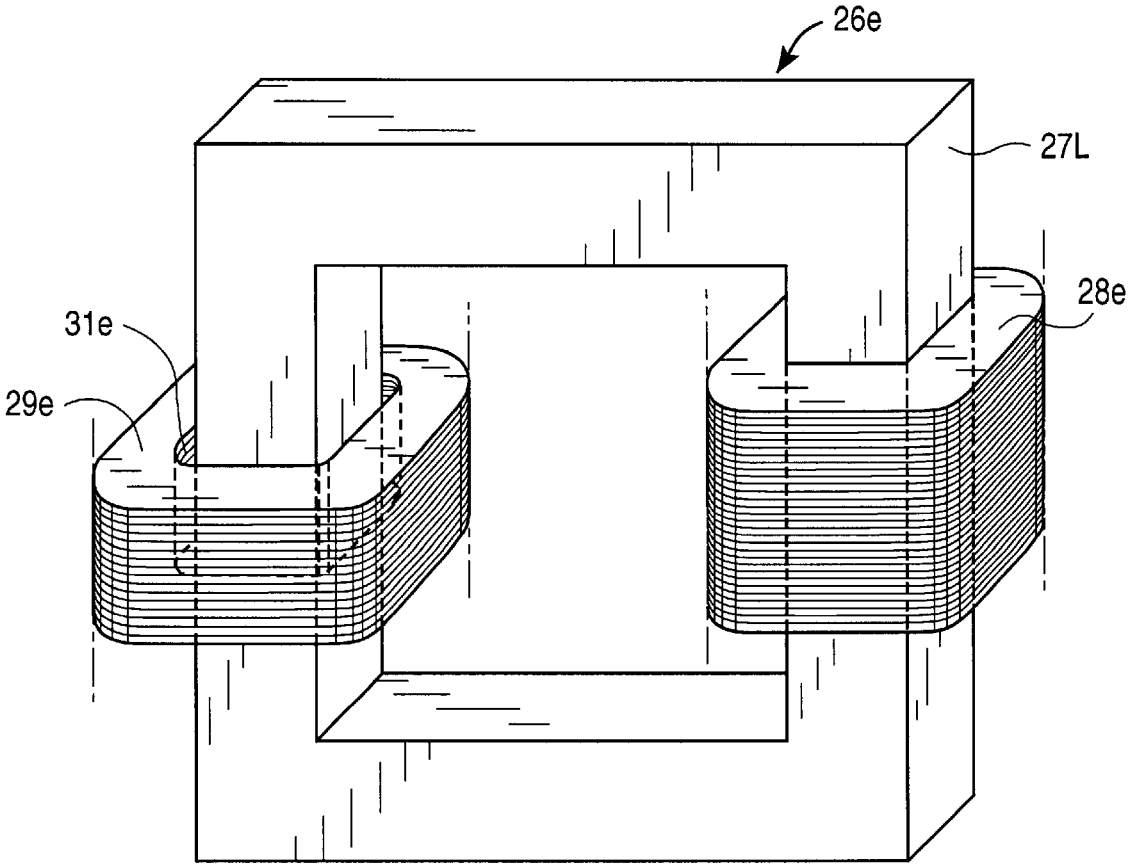
FIG. 6 is a perspective view of still another modification of a transformer structure.

FIG. 6 illustrates a further modification using a so-called square toroidal core 26*e* rather than the rectangle core of FIG. 1. Primary coil 28*e* is wound around one side of core 27*l*. Secondary coil 29*e* is made oversize so that there is a space 31e between the coil 29*e* and the core 27*l*.

Figure 7:
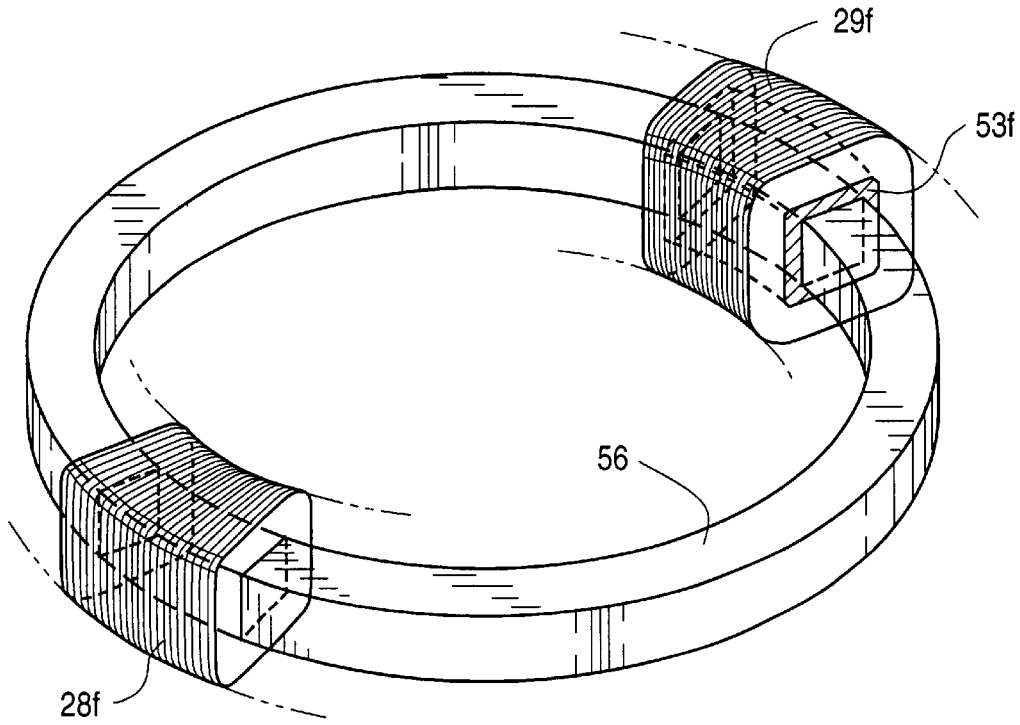
FIG. 7 is another modified transformer structure.

In FIG. 7 core 56 is toroidal but square in cross section and the secondary coil 29*f* is spaced from core 56 by spacer 53*f*.

Figure 8:
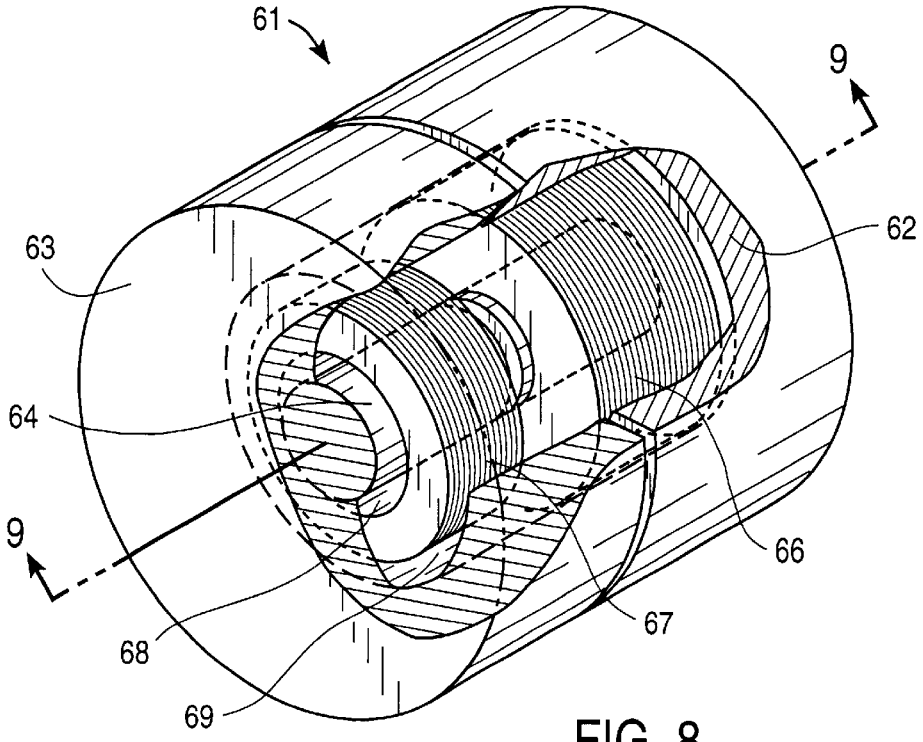
FIG. 8 is a further modified transformer structure partly broken away to reveal internal construction.
Figure 9:
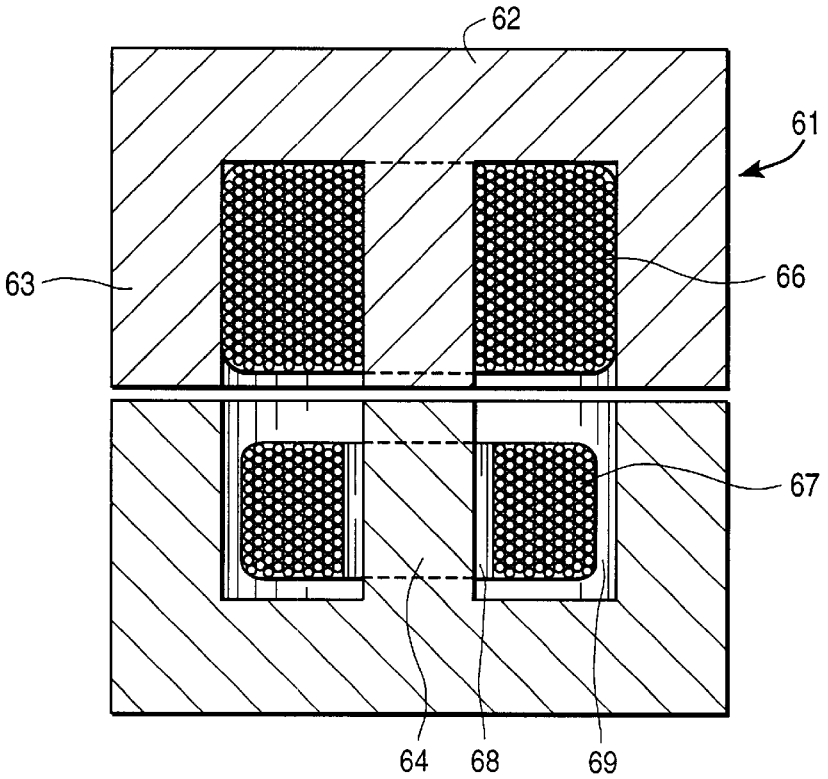
FIG. 9 is a sectional view taken substantially along the line 9—9 of FIG. 8.

FIGS. 8 and 9 illustrate a "pot" type transformer 61 which is normally filled with epoxy resin or other filler (not shown). One typical type of pot transformer 61 has a circular base 62. Outer ring 63 extends upward from base 62 and a center post 64 extends upward from the center of base 62. Primary and secondary coils 66, 67, respectively, are wrapped around center post 64, there being a gap 68 between secondary coil 66 and post 64 as well as a gap 69 between coil 67 and ring 63.

In other respects the modifications of FIGS. 2–3, 4, 5, 6 and 7 resemble preceding modifications and the same reference numerals followed by subscripts a, c, d, e and f, respectively designate corresponding parts.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A system for maintaining electronic components at low temperature within a refrigerated package comprising:

a transformer to supply power to said components, said transformer comprising a core, a first coil around said core, a coil around said second core, and a heat sink coupled to said second coil, said second coil being spaced from said core by a gap; and a housing under vacuum in which said transformer and said refrigerated package are located.

2. A system according to claim 1 in which said first and second coils are primary and secondary coils, respectively.

3. A system according to claim 1 which further comprises a spacer of low thermal conductivity in said gap.

4. A system according to claim 1 in which said core is rectangular.

5. A system according to claim 1 in which said core is square.

6. A transformer according to claim 1 in which said core is of "E" shape having a central arm, said coils being wound around said central arm.

7. A transformer according to claim 1 in which said core is ring-shaped.

8. A system according to claim 1 in which said transformer is of pot type comprising a base, a ring extending from said base and a post concentric with said ring extending from said base, said first and second coils being spaced from each other and each wound around said post, said second coil being spaced from said post and from said ring.

9. A system for maintaining electronic components at low temperatures within a refrigerated package comprising:

a transformer to supply power to said components, said transformer comprising a core, said core being formed with a gap separating said core into first and second core sections, a first coil around said first core section and a second coil around said second core section; and a housing under vacuum in which said transformer and said package are located.

10. A system according to claim 9, wherein said transformer further comprises a heat sink coupled to said second coil.

11. A system according to claim 9 in which said second coil is separated from said second core section by a second gap.

12. A system according to claim 11 which further comprises a spacer of low thermal conductivity in said second gap.

* * * * *